United States Patent [19]

Wolf

[11] Patent Number: 4,750,535

[45] Date of Patent: Jun. 14, 1988

[54] APPARATUS FOR THE PRODUCTION OF BEAMS HAVING THE SHAPE OF A PRISM OR OF A TRUNCATED PYRAMID

[75] Inventor: Johann Wolf, Scharnstein, Austria

[73] Assignee: Wolf Systembau Gesellschaft m.b.H. KG., Scharnstein, Austria

[21] Appl. No.: 930,087

[22] Filed: Nov. 13, 1986

[30] Foreign Application Priority Data

Nov. 13, 1985 [AT] Austria ..... 3308/85

[51] Int. Cl.[4] ..... B27L 11/00

[52] U.S. Cl. ..... 144/373; 144/39; 144/162.12; 144/176

[58] Field of Search ..... 144/39, 41, 162 R, 176, 144/359, 373, 369, 370; 83/460

[56] References Cited

U.S. PATENT DOCUMENTS

| | | | |
|---|---|---|---|
| 3,361,167 | 1/1968 | Farnsworth | 144/176 X |
| 4,440,203 | 4/1984 | Ostberg | 144/176 X |
| 4,637,443 | 1/1987 | Jansson | 144/39 |

FOREIGN PATENT DOCUMENTS

| | | |
|---|---|---|
| 375862 | 9/1984 | Austria . |
| 3151188 | 8/1982 | Fed. Rep. of Germany . |
| 3114843 | 10/1982 | Fed. Rep. of Germany . |

*Primary Examiner*—W. Donald Bray
*Attorney, Agent, or Firm*—Young & Thompson

[57] ABSTRACT

An apparatus is disclosed for the production of prismatic or truncated-pyramid-shaped beams from boles (4) by edging the latter with the aid of at least two machining tools (13, 14) wherein a relative movement is generated between the bole (4) to be machined and the machining tools (13, 14). In order to be able to manufacture conical beams, the machining tools are adjustable during edging transversely to the direction of the longitudinal extension of the bole (4) the result being a linear relative motion of the machining tools (13, 14) inclined under an acute angle with respect to the axis of the bole (4).

18 Claims, 2 Drawing Sheets

FIG.1
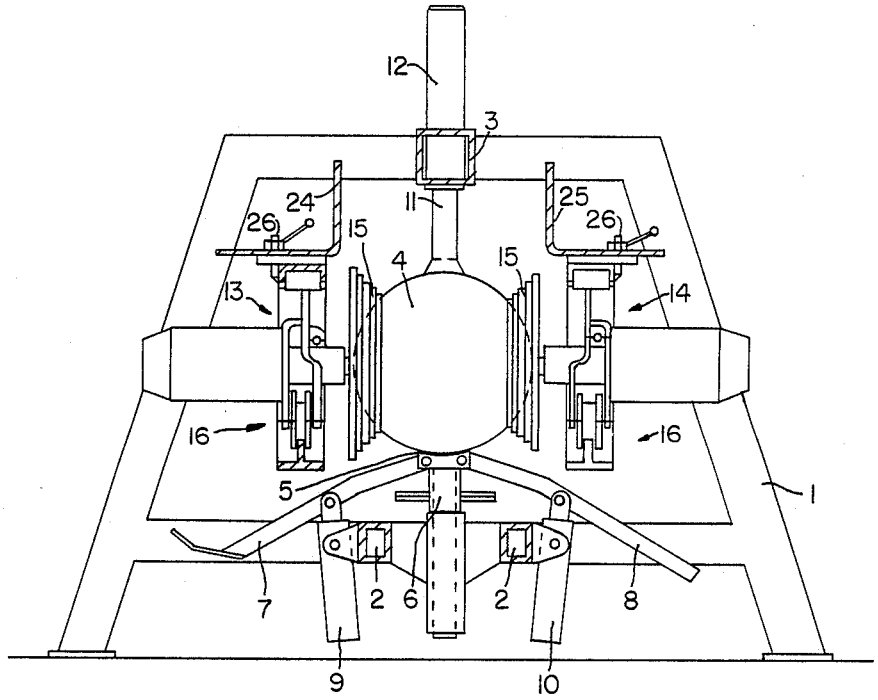
FIG.2
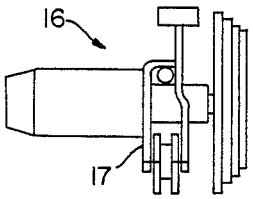
FIG.3
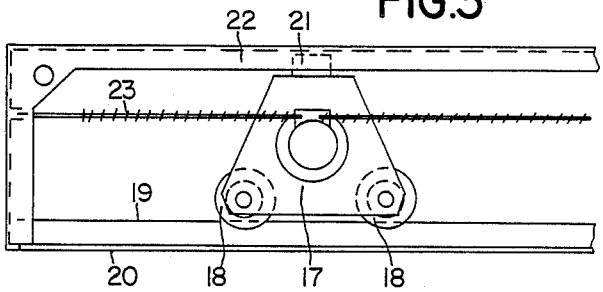
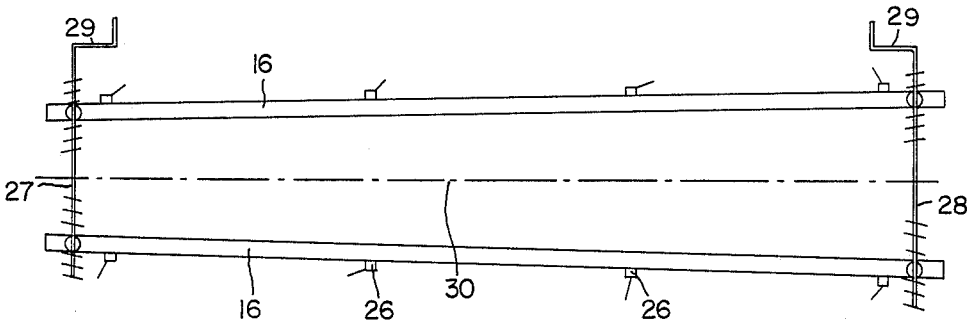
FIG.4

FIG. 5
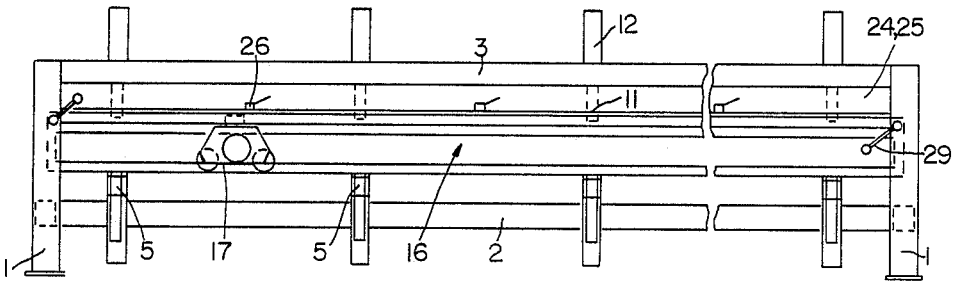
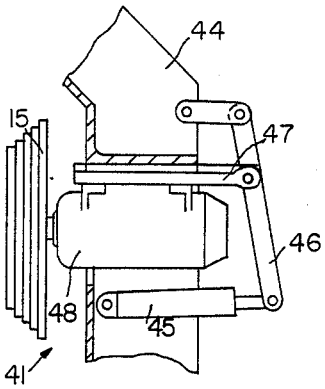
FIG. 6
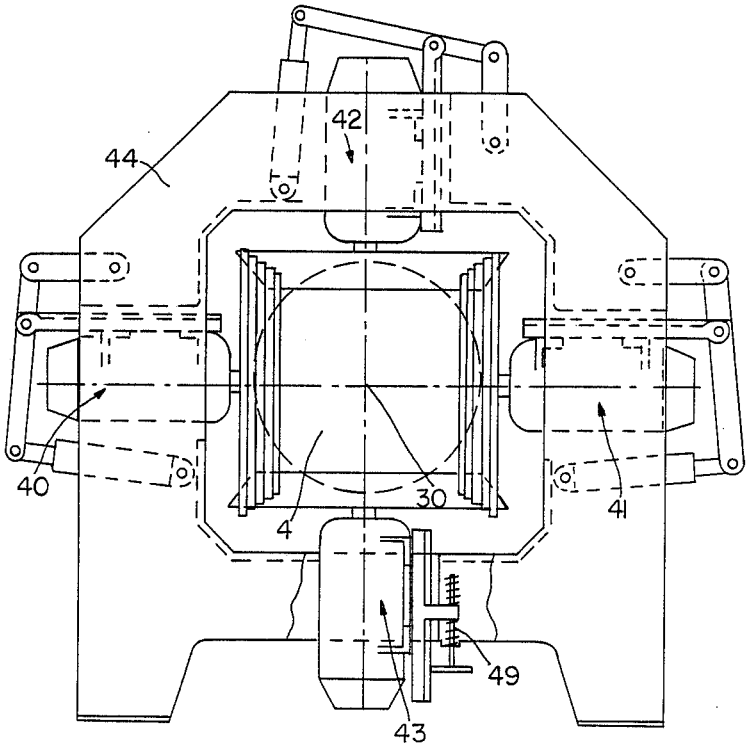
FIG. 7

APPARATUS FOR THE PRODUCTION OF BEAMS HAVING THE SHAPE OF A PRISM OR OF A TRUNCATED PYRAMID

The invention relates to an apparatus for the production of prismatic or truncated-pyramid-shaped beams from boles by edging the latter with at least two mutually opposed machining tools, such as saws, planers, cutters, or the like, and with a device for generating a relative motion between the bole to be machined and the machining tools.

The conventional gate saws only provide for cutting boles into prismatic beams. Other devices also permit a conical cut, and thus the manufacture of beams having a truncated pyramid shape, only after time-consuming aligning and clamping operations. This mode of operation is disadvantageous, especially in case of relatively long boles, since in such a case the difference in diameter between the base diameter and the crown diameter is large, and accordingly high wastage is the result.

Also, devices have been known wherein edging is performed in correspondence with the outline of the bole, i.e. with approximately the same thickness, by means of revolving planer or cutter tools. The tools are controlled in this process manually by feeling the bole. This does result in beams having a truncated pyramid shape, but the machined surfaces are nonuniform and consequently unsuitable for processing into composite girders. Rather, beams produced in this way can be utilized merely as single supports for subordinate purposes, for example for the erection of scaffolds etc.

Furthermore, edging devices have been known (cf. DOS Nos. 3,151,188 and 3,114,843 and Austrian Pat. No. 375,862) wherein the edging tools are actually adjustable transversely to the bole axis, but the adjustment of the edging tools takes place stepwise, it being possible in this way to produce surfaces extending always in parallel to the axis of the bole.

It is an object of the invention to provide an apparatus making it possible to selectively edge boles in a linear fashion in a prismatic or truncated pyramid shape so that these beams can be processed into composite girders. In this connection, the surfaces of the beams obtained after edging are to be extensively planar.

This object has been attained according to the invention by providing that the machining tools are movable during edging transversely to the direction of the longitudinal extension of the bole along linear routes inclined with respect to the axis of the bole, especially converging toward the axis of the bole.

It is to be noted at this point that the term "prismatic beam" is intended to include not only beams machined along four faces, but also beams exhibiting only two mutually opposed machined surfaces, i.e. faces that extend planar and parallel to each other while the two other faces are not machined. Analogously, the expression "truncated-pyramid-shaped beam" utilized in this description also encompasses beams possessing only two converging, machined surfaces.

Moreover, it is possible by means of the apparatus of this invention to manufacture beams wherein unmachined areas exist between the machined surfaces; in other words, the planes defined by the machined surfaces intersect externally of the beam.

The apparatus of this invention can be constructed so that the bole to be machined is clamped in place and the machining tools are guided along the bole on two opposite sides. In accordance with another embodiment, the machining tools are supported in a fixed frame and the bole is being moved along a conveying path with respect to the machining tools.

Additional features and details of the apparatus according to this invention can be derived from the dependent claims and from the following description of two embodiments with reference to the appended drawings wherein:

FIG. 1 shows an embodiment of the apparatus according to the invention wherein two mutually opposed machining tools are moved along a stationary bole, seen from one end, FIG. 2 shows the guidance of a machining tool of the apparatus of FIG. 1, FIG. 3 shows, in a lateral view, part of the guide means of FIG. 2, FIG. 4 shows schematically two guide tracks in a top view, and FIG. 5 shows the apparatus of FIG. 1 in a lateral view, FIG. 6 shows the arrangement of a machining tool adjustable transversely to the longitudinal extension of the bole, and FIG. 7 shows an embodiment of the apparatus of this invention wherein a bole is moved past stationary machining tools.

The apparatus illustrated in FIGS. 1–5 comprises at both ends of the device substantially H-shaped trestles 1 joined with each other into a frame by means of longitudinal supports 2 and 3. Several saddles 5 are provided at the frame for holding a bole 4, the latter resting on these saddles. The saddles 5 are vertically adjustable with the aid of a spindle drive mechanism 6. Respectively two lifting arms 7 and 8 are articulated at the saddles 5; these arms are pivotable with the aid of pressure medium motors 9 and 10. The lifting arms 7 and 8 serve for placing the bole 4 and for the lateral removal of a finished machined beam. Furthermore, hold-downs 11 acting on the bole 4 from above are arranged in the frame, individual pressure medium motors 12 being provided for their operation. The hold-downs 11 clamp the bole 4 in place with respect to the saddles 5.

As can be seen, in particular, from FIG. 1, two mutually opposed machining tools 13 and 14 are provided in the apparatus; these are cutters 15 in the illustrated embodiment, engaging at opposite sides of the bole 4. The machining tools 13 and 14 are displaceable in guide means 16 along the bole 4, the machining tools exhibiting shields 17 (FIG. 3) for this purpose. Each shield 17 has at the bottom two grooved rollers 18 traveling along a rib 19 of a T-profile rail 20. Each shield 17 furthermore exhibits a roller 21 at the top, engaging into a rail 22 having a U-shaped profile and being open at the bottom. For moving the shields 17 and thus the machining tools 13 and 14, feed shafts 23 are provided, for example, or, according to an embodiment that is not illustrated, rope pulleys and/or chain winches are included for this purpose. The guide means 16 are adjustably mounted to L-profile rails 24, 25 affixed to the frame. In order to be able to fix the guide means 16 in the desired position within the frame, clamping screws 26 are provided.

As illustrated in FIG. 4, adjusting spindles 27 and 28 are arranged at the ends of the guides 16; these spindles can be operated with the aid of hand cranks 29. In this way, the guide means 16 can be adjusted symmetrically to the axis 30 of the bole 4 clamped into the frame; in this connection, it is possible to align the guide means 16, besides being oriented in parallel to the axis 30 (manufacture of prismatic beams), also at an acute angle with respect to the axis 30 so that beams can be produced having the shape of a truncated cone.

In place of the illustrated spindles 27 and 28, exhibiting thread sections running counter to each other, it is also possible to employ, for adjusting the guide means 16, other devices such as pressure medium cylinders.

An arrangement of the apparatus, not shown, is also possible wherein the guide means 16 are mounted in the frame of the apparatus in parallel to the axis 30 of the bole 4 and the machining tools 13 and 14 are adjusted, during their movement along the bole 4 to be machined, transversely to the longitudinal extension (axis 30) of the bole 4 in order to obtain the desired wedgeshaped machining route following the natural conicity of tree trunks. Adjustment of the machining tools with respect to the shields 17 carrying these tools can be controlled with the aid of servomotors regulated in dependence on the displacement (similarly to FIG. 6) or with the aid of reduction gear mechanisms, driven, for example, by the feed shaft 23. Another possibility resides in activating the drive mechanisms for the transverse adjustment of the machining tools 13, 14 with respect to their shields 17 by way of wheels traveling along the guide means 16. Finally, another possibility resides in detecting the distance traversed by the machining tools 13 and 14 along the bole 4 by way of distance measuring units (e.g. incremental transducers) and adjusting the machining tools transversely to the longitudinal extension of the bole 4 or, respectively, transversely to their direction of travel, in dependence on the distance traversed.

No matter how the transverse movement of the machining tools 13, 14 is effected, it is ensured in any event that a linear movement results, based on the longitudinal extension (axis 30) of the bole 4.

If it is intended to manufacture, by means of the apparatus shown in FIGS. 1–5, a prismatic or truncated-pyramid-shaped beam machined along four faces, then the bole, initially machined on two opposite sides, is turned by 90°, and the two remaining sides are edged in a further working steps.

Whereas, in the apparatus illustrated in FIGS. 1–5, the relative motion between the machining tools 13 and 14 and the bole to be edged is brought about by moving the machining tools 13 and 14 along the bole 4, the embodiment shown in FIGS. 6 and 7 for the apparatus of this invention provides for moving the bole 4 past machining tools 40–43 fixedly arranged with respect to the longitudinal direction of the bole 4. As can be seen from FIG. 7, the machining tools 40–43 are supported, opposing each other in pairs, in a frame 44, the pairs of machining tools 40–43 being disposed mutually offset as seen in the longitudinal direction of the bole to avoid intermeshing of the machining tools with observation of an assumed displacement path transversely to the direction of motion of the bole 4.

Driven conveyor rolls, not illustrated in detail, arranged, for example, in pincer form are provided on both sides of the frame 44 for moving the bole 4 with respect to the machining tools 40–43. Conveyor tracks for the feeding and discharging of the boles and, respectively, beams are provided in front of and behind the conveyor rolls.

As illustrated in FIG. 6, using machining tool 41 as an example, pressure medium motors 45 are respectively included for the transverse adjustment of the machining tool; these motors engage by way of a lever linkage 46 at a guide strip 47 displaceably accommodated in the frame 44. The motor 48 of the machining tool is connected to this guide strip 47. Instead of the pressure medium motor 45, it is also possible to provide motor-driven adjusting spindles or the like. Since, in the embodiment according to FIG. 7, the axis 30 of the bole 4 is inclined with respect to the conveying direction of the bole 4 through the apparatus, the machining tool engaging the bole 4 from below need only be set to the required ablation thickness, for which purpose the tool is associated with a setscrew 49. In contrast thereto, the machining tool 42 lying oppositely to the machining tool 43 and engaging the bole 4 from the top executes a transverse stroke corresponding to the entire conicity of the bole 4 while the bole passes through the apparatus. The machining tools 40 and 41 perform a transverse stroke, just as the machining tools 13 and 14 of the embodiment according to FIGS. 1–5, which stroke corresponds essentially to half the conicity of the bole 4 to be machined.

The embodiment of the apparatus of this invention illustrated in FIGS. 6 and 7 makes it possible, in an efficient continuous method, to manufacture conical beams having planar lateral faces. However, this apparatus can also be utilized for the manufacture of prismatic beams. In this case, it is recommended to perform the machining step in two working operations, for example in forward and rearward traveling mode, the tree being turned once by 90° between the forward and backward runs. It is advantageous, in this connection, to fix the two laterally engaging machining tools 40 and 41 in place with respect to the frame 44, and to move the machining tools 42 and 43 of the other pair of machining tools out of engagement with the bole 4.

If, in the embodiment according to FIGS. 1–5, the transverse adjustability of the machining tools takes place as in FIG. 6, then a single guide track is adequate, and both tools can be moved on a carrier common to both of them along the bole 4, during which procedure the tools are adjusted in dependence on the feed path transversely to the longitudinal extension of the bole 4.

It is of advantage in every embodiment of the apparatus of this invention to make the relationship between the relative motion between the bole and the machining tools with respect to the transverse stroke of the machining tools to be adjustable within limits and preselectable, for example with the aid of index markings, and retain this relationship unchanged for the respectively chosen operating step so that the resultant movement of the machining tools with respect to the bole is a linear one. This can be achieved in the embodiment according to FIG. 1 in a simple way by providing markers at both ends of the frame which simplify the adjustment of the apparatus in correspondence with the beam thickness and, respectively, in correspondence with the desired conicity thereof.

What is claimed is:

1. In a method for producing prismatic and truncated pyramidal beams by edging boles having a longitudinal axis, comprising effecting relative movement between a said bole to be machined and at least two opposed machining tools, the improvement in combination therewith comprising moving said at least two opposed machining tools transversely of the said longitudinal axis of said bole during said relative movement therebetween, whereby said at least two opposed machining tools define cutting paths relative to said bole extending obliquely of said longitudinal axis of said bole.

2. Method according to claim 1, wherein said bole is moved along its said longitudinal axis relative to a stationary frame on which are mounted said at least two opposed machining tools, each said tool being mounted for movement in a plate perpendicular to said longitudinal axis of said bole.

3. In an apparatus for producing prismatic and truncated pyramidal beams by edging boles having a longitudinal axis, comprising at least two opposed machining tools and means for effecting relative movement between a said bole to be machined and said at least two opposed machining tools, the improvement in combination therewith comprising means for moving said at least two opposed machining tools transversely of the said longitudinal axis of a said bole to be machined during said relative movement therebetween, whereby said at least two opposed machining tools define cutting paths relative to a said bole extending obliquely of said longitudinal axis of said bole.

4. Apparatus according to claim 3, wherein said means for transverse moving of said tools comprise means for moving said at least two opposed machining tools transversely of said longitudinal axis of a said bole to be machined during said relative movement therebetween and at a rate directly proportional to a rate of said relative movement, whereby said cutting paths are straight.

5. Apparatus according to claim 3, wherein said means for transverse moving of said tools comprise means for imposing on said tools a predetermined ratio of transverse movement of said tools to the extent of said relative movement between said tools and said bole, thereby to define a desired oblique angle at which said cutting paths extend from said longitudinal axis of said bole.

6. Apparatus according to claim 3, wherein each of said at least two opposed machining tools comprises a side facing said bole and a side opposite said facing side, said means for transverse moving of said tools comprising means acting on said opposite sides of said tools and displacing said tools symmetrically relative to said longitudinal axis of said bole.

7. Apparatus according to claim 3, further comprising a frame having means for fixing a said bole therein, said means for transverse moving of said tools comprising means for moving said tools along said longitudinal axis of said bole.

8. Apparatus according to claim 7, wherein said fixing means comprise clamping means disposed respectively in upper and lower portions of said frame and adapted to bear respectively on upper and lower portions of a said bole, said at least two opposed machining tools being adapted to edge respectively opposite lateral surfaces of a said bole exposed between said clamping means.

9. Apparatus according to claim 8, wherein said lower clamping means comprises a vertically adjustable saddle adapted to straddle a said bole.

10. Apparatus according to claim 9, said lower clamping means further comprising pressure medium motors acting on pivotable lifting arms connected to said saddle.

11. Apparatus according to claim 3, wherein said means for transverse moving of said tools comprise guide means on which said tools are mounted for movement therealong, said guide means being adjustable in direction relative to said longitudinal axis of said bole.

12. Apparatus according to claim 11, comprising a said guide means individual to each said tool, said guide means being adjustable symmetrically relative to said longitudinal axis of said bole.

13. Apparatus according to claim 12, wherein said guide means corresponding to said at least two opposed machining tools are interconnected by an adjusting spindle having oppositely threaded sections each engaging in a nut individual to a said guide means.

14. Apparatus according to claim 7, said means for moving said tools along said longitudinal axis of said bole comprising guide rails extending along and at an oblique angle relative to said longitudinal axis of said bole, said means for transverse moving of said tools further comprising a shield having rollers bearing on said guide rails.

15. Apparatus according to claim 14, wherein each said shield comprises a grooved lower roller travelling along a rib of a T-shaped lower said guide rail and at least one upper roller engaging a U-shaped upper said guide rail.

16. Apparatus according to claim 11, further comprising means for locking said adjustable guide means in position after adjustment thereof, said locking means comprising clamping screws.

17. Apparatus according to claim 11 comprising means for displacing said tools transversely of said guide means.

18. Apparatus according to claim 3, further comprising a frame adapted to receive a said bole travelling parallel to its said longitudinal axis, said at least two opposed machining tools being fixed to said frame for transverse movement relative to said direction of travel of said bole.

* * * * *